US012600436B2

(12) United States Patent
Johnsen et al.

(10) Patent No.: US 12,600,436 B2
(45) Date of Patent: Apr. 14, 2026

(54) MOORING SYSTEMS FOR FIXED MARINE STRUCTURES

(71) Applicant: Entrion Wind, Inc., Houston, TX (US)

(72) Inventors: Eivind Johnsen, Houston, TX (US); Li Lee, Las Vegas, NV (US)

(73) Assignee: Entrion Wind, Inc., Houston, TX (US)

( * ) Notice: Subject to any disclaimer, the term of this patent is extended or adjusted under 35 U.S.C. 154(b) by 0 days.

(21) Appl. No.: 18/718,278

(22) PCT Filed: Jan. 20, 2023

(86) PCT No.: PCT/US2023/011218
§ 371 (c)(1),
(2) Date: Jun. 10, 2024

(87) PCT Pub. No.: WO2023/141257
PCT Pub. Date: Jul. 27, 2023

(65) Prior Publication Data

US 2025/0050978 A1 Feb. 13, 2025

Related U.S. Application Data

(60) Provisional application No. 63/266,989, filed on Jan. 21, 2022.

(51) Int. Cl.
*B63B 21/50* (2006.01)
*B63B 21/18* (2006.01)
(Continued)

(52) U.S. Cl.
CPC ..... *B63B 21/50* (2013.01); *B63B 21/18* (2013.01); *B63B 35/44* (2013.01);
(Continued)

(58) Field of Classification Search
CPC ..... E02B 2017/0065; E02B 2017/0091; F03D 13/126; F03D 13/25; B63B 21/50; B63B 21/18; B63B 2035/446
See application file for complete search history.

(56) References Cited

U.S. PATENT DOCUMENTS 4,226,555 A * 10/1980 Bourne, Jr. ..... B63B 21/502 114/264
4,425,056 A 1/1984 Hunter
(Continued)

FOREIGN PATENT DOCUMENTS

CN 208763818 U 4/2019
EP 1741928 A1 1/2007
(Continued)

OTHER PUBLICATIONS

The PCT Search Report and Written Opinion mailed Apr. 5, 2023 for PCT application No. PCT/US2023/011218, 9 pages.
(Continued)

*Primary Examiner* — Frederick L Lagman
(74) *Attorney, Agent, or Firm* — Lee & Hayes, P.C.

(57) ABSTRACT

Techniques are disclosed herein for minimizing movement of a fixed marine structure. Using the technologies described, a wind turbine may be mounted on a fixed marine platform (e.g., a fully restrained platform (FRP)) that is secured by mooring lines that may be maintained at a tension to restrain movement of the platform due to environmental loads (e.g., wind, waves, etc.). The mooring lines may be attached to the platform with assemblies that include a stopper attached to the mooring line and engaged with a mooring porch. The stopper may be positioned and/or repositioned to adjust the tension on the connected mooring line and secured in the adjusted position using the various systems and techniques described herein.

20 Claims, 10 Drawing Sheets

(51) Int. Cl.

| | |
|---|---|
| ***B63B 35/44*** | (2006.01) |
| *B63B 21/00* | (2006.01) |
| *E02B 17/00* | (2006.01) |

(52) U.S. Cl.

CPC ... *B63B 2021/003* (2013.01); *B63B 2021/505* (2013.01); *B63B 2035/446* (2013.01); *E02B 2017/0065* (2013.01)

(56) References Cited

U.S. PATENT DOCUMENTS

| | | | | |
|---|---|---|---|---|
| 4,844,659 | A | 7/1989 | Hunter et al. | |
| 4,936,710 | A | 6/1990 | Petty et al. | |
| 5,174,687 | A | 12/1992 | Dunlop et al. | |
| 5,905,212 | A | 5/1999 | Moses et al. | |
| 9,227,700 | B2 * | 1/2016 | Pontaut | B63B 21/04 |
| 9,381,977 | B2 | 7/2016 | Leverette et al. | |
| 2010/0150665 | A1 | 6/2010 | Karal | |
| 2012/0189390 | A1 * | 7/2012 | Belinsky | F03D 13/10 405/209 |
| 2020/0339225 | A1 * | 10/2020 | Lervik | B63B 21/18 |

FOREIGN PATENT DOCUMENTS

| | | | | |
|---|---|---|---|---|
| EP | 2905215 | A1 | 8/2015 | |
| ES | 2454044 | A1 * | 4/2014 | F03D 13/20 |
| GB | 2569359 | A * | 6/2019 | B63B 22/18 |
| KR | 102320119 | B1 * | 11/2021 | B63B 21/18 |

OTHER PUBLICATIONS

Search Report for European Application No. 23743754.6, Dated Jan. 5, 2026, 10 pages.

* cited by examiner

MOORING SYSTEMS FOR FIXED MARINE STRUCTURES

CROSS-REFERENCE TO RELATED APPLICATIONS

This application is a U.S. national stage application under 35 USC § 371 of International Application No. PCT/US23/11218 filed on Jan. 20, 2023 and entitled "MOORING SYSTEMS FOR FIXED MARINE STRUCTURES," which claims priority to U.S. Provisional Application No. 63/266,989 filed on Jan. 21, 2022, the entire contents of which are incorporated herein by reference.

BACKGROUND

Offshore regions of varying depths off coastlines offer tremendous potential as wind power resources. In deep-water regions (e.g., depths of approximately 120 meters or more), floating marine structures, commonly referred to as "platforms," are typically used for exploration activities and the mounting of wind turbines. In shallower regions (e.g., depths of approximately 50 meters or less), fixed structures that are mounted to the sea floor are commonly used to mount wind turbines and provide platforms for various activities. For platforms installed in either depth or depths in between, determining how to reduce movement of such platforms to support wind turbines, can be challenging. In an open ocean, winds, waves, and currents often act simultaneously and exert forces on the marine platforms causing the platforms to move.

DETAILED DESCRIPTION

Figure 1:
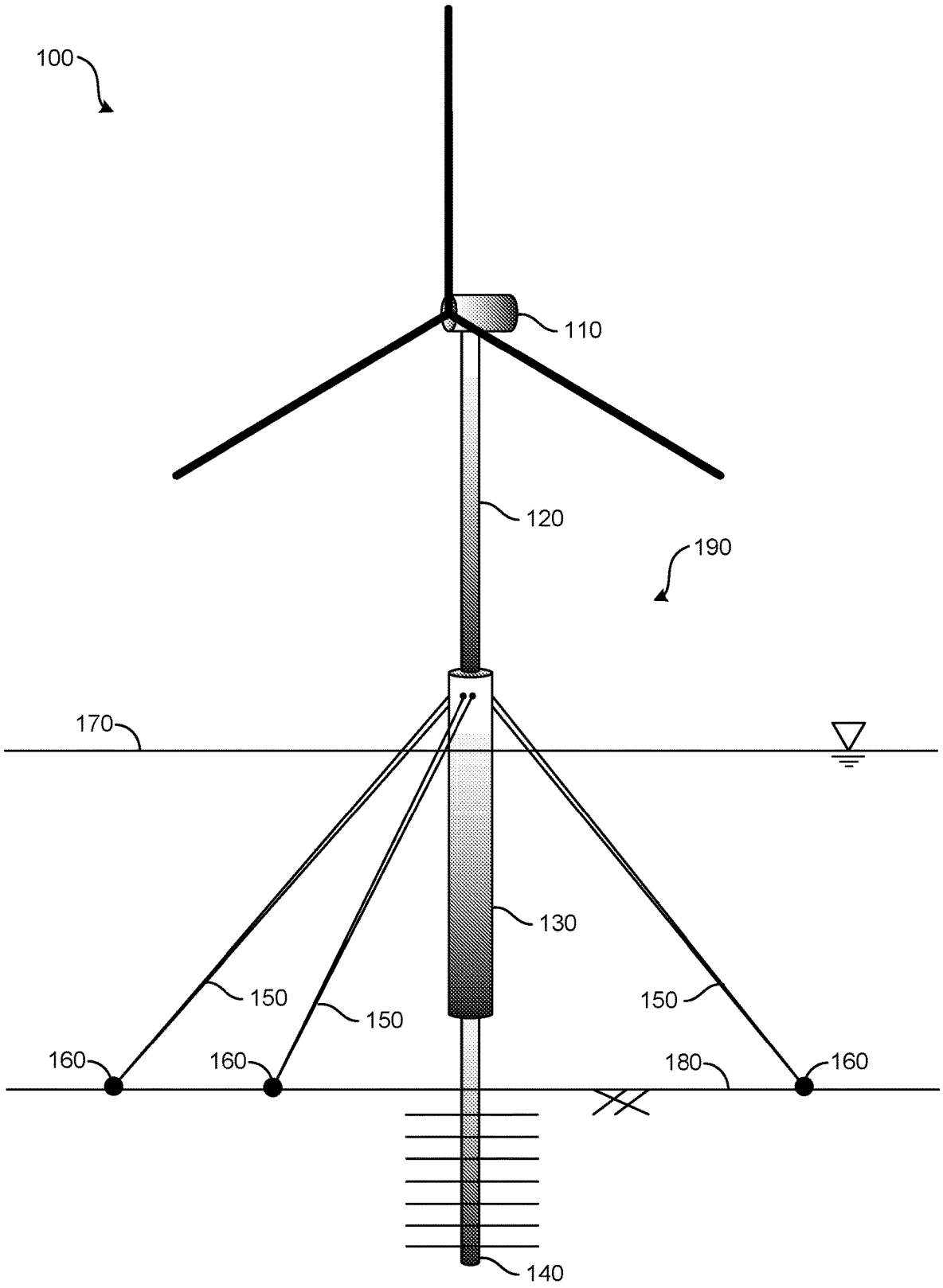
FIG. 1 illustrates an exemplary fully restrained platform (FRP) for supporting a wind turbine, in accordance with examples of the disclosure.

The following detailed description is directed to technologies for minimizing movement of a fixed marine structure, such as an offshore wind turbine. Using the technologies described herein, a wind turbine may be mounted on a fixed marine platform that is constructed and mounted on the seabed in water of any depth (e.g., shallow water (e.g., depth of less than 50 meters), intermediate depth water (e.g., depth of greater than 50 meters and less than 120 meters), and deep water (depth of greater than 120 meters)). In various examples, a wind turbine may be mounted on a fully restrained platform (FRP) monopile. A monopile is a pile structure that is driven into the seafloor and that may form a portion of or otherwise support a fixed marine platform, such as an FRP. As used herein, the term FRP refers to a platform that has motions restrained in 6 degrees-of-freedom (DOFs) and the term FRP-monopile refers to an FRP that includes a monopile.

For purposes of explanation, the main structural component of a platform can be viewed as a rigid body. Its motions may be characterized by and measured in 6 degrees-of-freedom (DOFs) including 3 translational DOFs (surge, sway, and heave) and 3 rotational DOFs (roll, pitch, and yaw). Environmental loads may apply force to the platform in one or more DOFs. Some of these loads are dynamic in nature, such as loads due to water waves, while others may be largely static, such as loads due to ocean current induced drag.

An example platform design philosophy is that in shallow waters, the environmental loads are mainly resisted by the lateral stiffness of the platform, which is designed to be "fixed." One such example is the jacket platform which is a lattice structure with its legs extending into the earth. In deeper waters, however, the amount of material required for a fixed platform may be uneconomical and therefore floating platforms may be used. Platform concepts may be configured with a variety of technologies to resist and/or allow motion operating at some or all of the 6 DOFs'. For example, a fixed marine platform using a bottom-mounted driven pile structure may be configured to resist motion in all of the 6 DOFs; a tension-leg platform (TLP) may allow (at least to some extent) surge, sway, and yaw motions; while a semisubmersible platform may allow (at least to some extent) motion in all of the 6 DOFs.

In current wind engineering practice, fixed ocean platforms may be used for shallow water regions where the water depth is less than 50-60 meters and where wind, wave, and current forces may be relatively less than in deep water regions. However, fixed ocean platforms (e.g., FRP-monopiles) may also be used in deeper water regions (e.g., up to 200 meters) that are subject to greater wind, wave, and current forces.

For a wind turbine to function effectively, it is desirable that its host structure has as little movement as possible. A wind turbine is supported by a platform that attempts to minimize motions in all of its 6 DOFs may more effectively generate power than turbines mounted on platforms that do not restrain motion in all 6 DOFs. Prior to the techniques described herein, no known fixed platforms that possess such features have been effectively implemented in intermediate-depth waters to host wind turbines. As described herein, a fixed marine structure is disclosed that reduces and/or minimizes motions in shallow and intermediate-depth water (e.g., depths of up to 120 meters or more in mild environments). The disclosed structures may host one or more wind turbines and associated structures and equipment.

An offshore wind turbine is a wind turbine mounted on an offshore platform. In various disclosed examples, the offshore platform may be an FRP-monopile. Examples of FRP-monopiles can be found, for example, in U.S. patent application Ser. No. 17/249,676, filed Mar. 9, 2021, and titled "Minimizing Movements of Offshore Wind Turbines," the contents of which are herein incorporated by reference in their entirety and for all purposes.

An offshore wind turbine mounted on an FRP-monopile generally includes six main components: (1) a single pile ("monopile") driven into the seafloor, (2) a wind tower to which a wind turbine is mounted, (3) a transition piece mounted to the monopile and to which the wind tower is mounted, (4) one or more anchors affixed to the seafloor, (5) one or more mooring lines affixed to the anchors and to one or both of the transition piece and the monopile, and (6) the wind turbine, which may include a nacelle (e.g., housing), a rotor hub, blades, and various other components. In addition to a wind turbine, other structures and equipment can also be mounted on a platform such as the disclosed FRP-monopile. As described in more detail below, the mooring lines may be connected to one or more connection components configured at the transition piece and/or monopile that may facilitate the application and adjustment of tension on the mooring lines.

Using the techniques described herein, the motions in all of the 6 DOFs of an offshore wind turbine mounted on a fixed marine structure may be reduced and/or restrained. The motions referred to herein are those caused by various types of environmental loading. The external forces causing the motions include those from waves and ocean currents on the structure, from the moorings along with any part of the turbine and/or structure in contact with water, and from winds on any part of the structure above the sea surface. Methods for the assembly, transportation, installation, and the development of the adjacent wind turbine units and associated structures are also disclosed. Additional details regarding minimizing motion of an offshore wind turbine will be presented below with regard to FIGS. 1-13.

In the following detailed description, references are made to the accompanying drawings that form a part hereof, and that show, by way of illustration, specific or generalized examples. The drawings herein are not drawn to scale. Like numerals represent like elements throughout the several figures (which may be referred to herein as a "FIG." or "FIGS.").

FIG. 1 illustrates an exemplary wind turbine system 100 supported by an FRP-monopile structure. The wind turbine system 100 may include a wind turbine 110 that may include a housing, a rotor hub, blades, and various other components associated with generating and/or collecting energy based on the rotation of one or more blades caused by wind forces. The wind turbine 110 may be mounted on, affixed to, or otherwise supported by a wind tower 120.

The wind tower 120 may be mounted on, affixed to, or otherwise supported by a transition piece 130 that may in turn be mounted on, affixed to, or otherwise supported by a monopile 140. Alternatively, the wind tower 120 may be mounted on the monopile 140. Together the wind tower 120, the transition piece 130, and the monopile 140 may form an FRP-monopile 190 that supports the wind turbine 110. Each of the wind tower 120, the transition piece 130, and the monopile 140 may be constructed of one or more materials of any type and may include one to more portions and/or components configured for various purposes. For example, the materials used to construct each of the wind tower 120, the transition piece 130, and the monopile 140 may be substantially rigid and/or treated to withstand oceanic environmental conditions (e.g., long-term exposure to salt water, high winds, etc.). In a particular example, one or more buoyant structures may be configured at or otherwise affixed to a submerged portion of one or more of the transition piece 130 and the monopile 140 to compensate for forces that may be applied to such components, such as mooring loads.

The monopile 140 may be a single pile driven into the seafloor 180 and may be substantially (e.g., entirely) submerged. The monopile 140 may affix to the transition piece 130 underwater. The transition piece 130 may include portions below water and above the waterline 170, supporting the wind tower 120 substantially (e.g., entirely) above the waterline 170.

One or more stability-enhancing components, such as moorings, may be affixed to the FRP-monopile 190. In examples, such components may be affixed to the transition piece 130 and/or to the monopile 140. For instance, one or more mooring lines 150 may be affixed or otherwise connected to the transition piece 130 and/or to the monopile 140. The mooring lines 150 may be affixed or otherwise attached to one or more anchors 160 that may be driven into or otherwise attached to the seafloor 180. As described in more detail below, the individual mooring lines 150 may be connected to one or more connection components configured at the transition piece 130 and/or at the monopile 140 that may facilitate the application and adjustment of tension on the mooring lines. The mooring lines 150 may resist the environmental forces that may be applied to the FRP-monopile 190.

The FRP-monopile 190 may form a beam column "clamped" at a first end (e.g., driven into the seafloor 180) and carrying a payload (e.g., the wind turbine 110) at the opposite end. The moorings lines 150 attached to the FRP-monopile 190 may form intermediate supports for this beam column. As an axially loaded structure configured in an oceanic environment, the FRP-monopile 190 may be subject to various steady and dynamic loads (e.g., from typical weather and less common weather events, such as storms). Such loads may be primarily lateral, for example resulting from winds waves, and currents.

Figure 2:
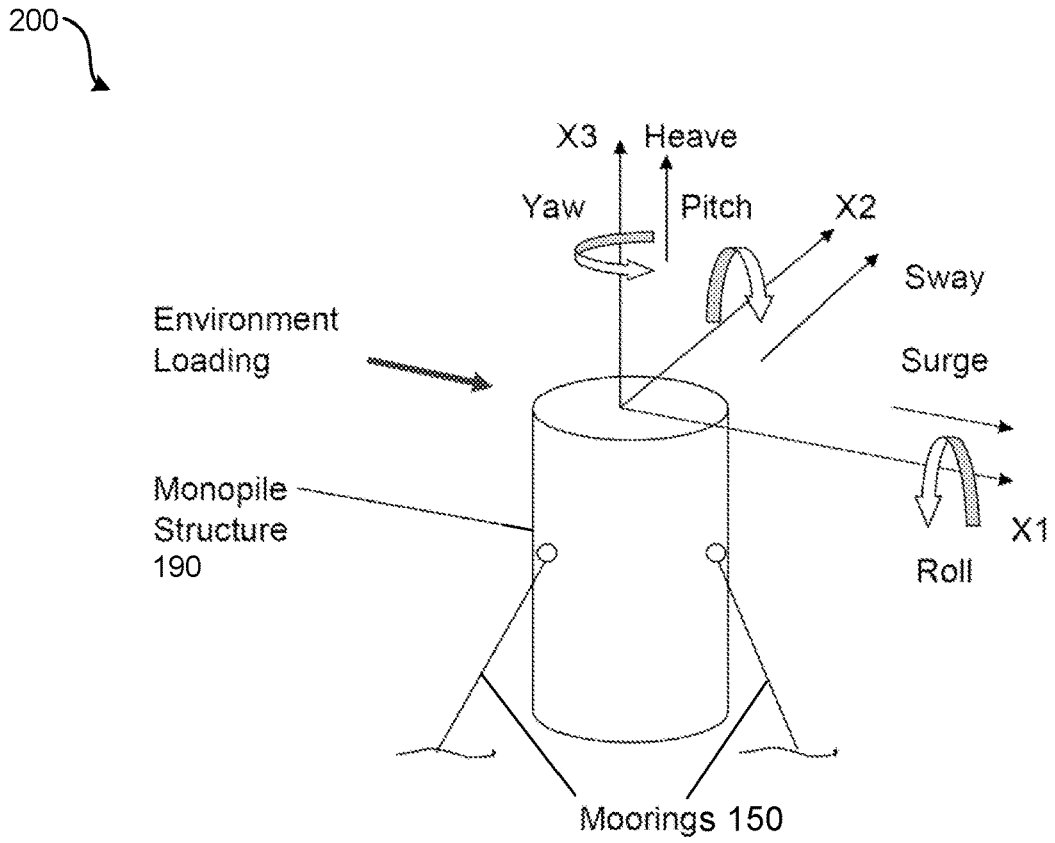
FIG. 2 illustrates diagrams representing 6 degree of freedoms (DOFs) motion to which a fixed marine structure may be subject and the natural frequencies in the 6 DOFs motions for a such a structure.
Figure 2:
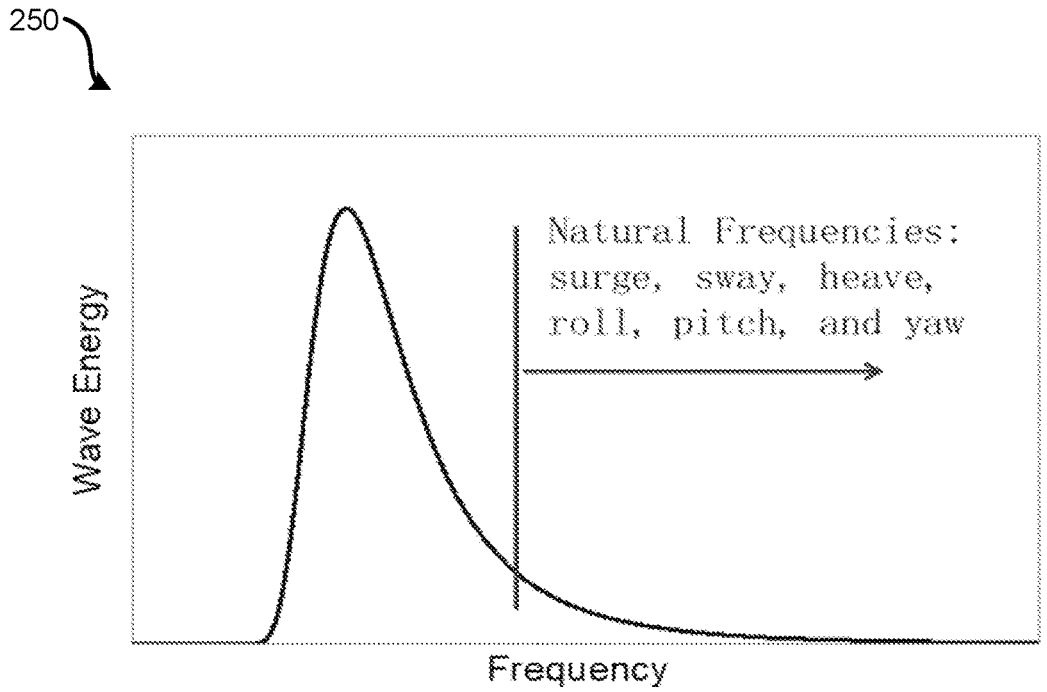

FIG. 2 provides a diagram 200 of the environmental loading to which the FRP-monopile 190 may be subject. As shown in diagram 200, the FRP-monopile 190 may be subject to motion in one or more of the 6 DOFs described above (heave, pitch, yaw, sway, surge, and roll). The moorings 150 in combination with the fixing of the FRP-monopile 190 into the seafloor (e.g., driving a first end of the FRP-monopile 190 into the seafloor) may restrain the motions applied to the FRP-monopile 190. This configuration of the FRP-monopile 190 may form a stiffness-controlled structure for supporting a wind turbine. An FRP-monopile-based structure implemented according to the described systems and techniques may have an increased lateral stiffness, for example, up to 30,000 kN/m, which may be a substantial improvement over known systems and techniques, especially for structures supporting wind turbine payloads of 4,000 MT or less.

FIG. 2 further illustrates in diagram 250 a relationship between the natural frequencies of exemplary FRP-monopiles implemented as described herein and wave frequencies. As illustrated in the diagram 250, the systems and techniques described herein, including the use of high tension mooring lines and associated aspects described herein, may be used to implement an FRP-monopile structure with a wave frequency zone substantially below the natural frequencies corresponding to the 6 DOFs. As shown in this diagram, all of the 6 natural frequencies for surge, sway, heave, roll, pitch, and yaw are on the right side of the significant wave frequency (the peak in the diagram 250) where the wave energy is the largest. Thus, an FRP-monopile structure implemented according to the instant disclosure may experience minimal movement in both normal operating conditions and extreme (e.g., storm) conditions.

While the examples described herein may refer to FRP-monopiles used as supporting structures for wind turbines, the disclosed FRP-monopiles may be used to provide marine support for other objects, systems, and components, such as energy storage units, offshore substations, etc. Because the disclosed FRP-monopiles are not payload sensitive, FRP-monopiles as described herein may be scaled up and/or down as needed to support objects having a wide range of mass.

As described throughout the instant disclosure, mooring lines may be used to provide further stability to an FRP-monopile. Mooring lines may be configured to maintain tension, in some examples, within a tension range. Over time, such mooring lines may loosen due to dynamic forces (e.g., wind, waves, currents, etc.). This loosening may result in mooring line tension falling outside of a design tension range, therefore reducing the ability of the loosened mooring lines to mitigate motion in the 6 DOFs. While re-tensioning systems and techniques have been successfully implemented for land-based applications and for floating marine platforms, these systems and techniques have not been successfully implemented for mooring lines used to stabilize fixed marine structures.

For example, the various systems and techniques available for re-tensioning in floating structures typically involve large increases or decreases in tension, preventing the fine tension adjustment often needed for FRP-monopile mooring lines. The various systems and techniques available for re-tensioning in land-based structures typically use less robust stabilizing components due to land-based structures being subject to lower axial loads (e.g., lower levels of motion in the 6 DOFs). FRP-monopile structures require stabilizing systems and techniques that address the higher axial loads to which such structures are subject while providing finer tension adjustment. The FRP-monopile structure stabilizing systems and techniques described herein address these issues while providing safer, easier, and more cost-effective means of applying and adjusting tension in the environments in which such structures are typically located.

Figure 3:
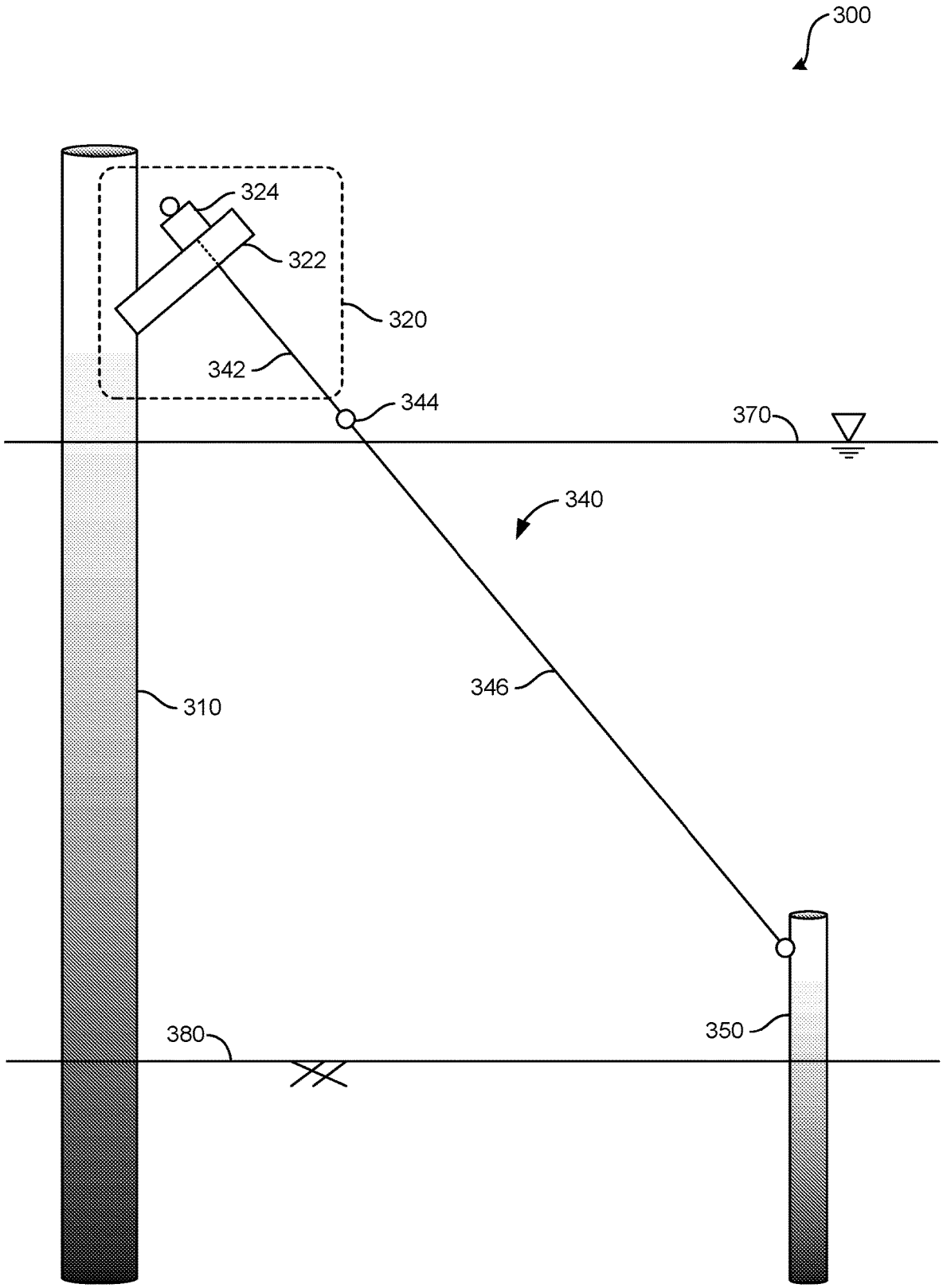
FIG. 3 illustrates an FRP, mooring lines, and a mooring line tensioning system, in accordance with examples of the disclosure.

FIG. 3 illustrates a mooring line system 300 for mitigating motion at an FRP-monopile according to various examples. An FRP-monopile 310 may be driven into or otherwise attached to a seafloor 380. At least a portion of the FRP-monopile 310 may be below the waterline 370, while another portion may be above the waterline. The FRP-monopile 310 illustrated in FIG. 3 may be a transition piece (e.g., transition piece 130 of FIG. 1), a monopile (e.g., monopile 140 of FIG. 1), one or more other portions of an FRP-monopile, or any combination thereof.

A mooring line 340 may be used to mitigate forces or motions applied to the FRP-monopile 310. Note that in this example, a single mooring line is illustrated for exemplary purposes, but multiple mooring lines and their associated components may typically be installed at an FRP-monopile. The mooring line 340 may include a mooring line segment 342 that is substantially above the waterline 370, a mooring line segment 346 that is substantially below the waterline 370, and a connector 344 that may connect the mooring line segment 342 to the mooring line segment 346 (approximately at or about the waterline 370 in some examples).

The use of these mooring line segments 342 and 346 and the connector 344 may facilitate the ease of installation of the mooring line 340. For example, an anchor 350 may be driven into or otherwise attached to the seafloor 380 and the lower mooring line segment 346 may be attached to the anchor 350. The mooring line segment 346 may later be attached to the upper mooring line segment 342 using the connector 344 when convenient. For example, the FRP-monopile 310 and the anchor 350 may be installed on independent schedules and the mooring line 340 fully connected once both the FRP-monopile 310 and the anchor 350 have been installed.

A top mooring assembly (TMA) 320 may be mounted on or otherwise attached to the FRP-monopile 310. In various examples, the TMA 320 may be mounted to the FRP-monopile 310 substantially above the waterline 370. The TMA 320 may include a mooring porch 322 affixed to the FRP-monopile 310 and that may directly bear the load applied by the mooring line 340 tension. The porch 322 may be welded or otherwise permanently and non-detachably affixed to the FRP-monopile 310. The TMA 320 may further include a stopper 324 to which the mooring line 340 may be connected. The mooring line 340 may connect to the stopper 324 above the porch 322 and pass through an opening in the porch 322, exiting below the porch 322. This opening may prevent the stopper 324 from passing through the porch 322 (e.g., may be smaller than the dimensions of the stopper 324). By connecting the mooring line 340 to the stopper 324, the stopper 324 may be configured to prevent the mooring line 340 from moving below the porch 322. By applying a linear upwards force to the stopper 324 (e.g., "pulling" the stopper 324 up), the tension in the mooring line 340 may be increased. Detailed examples of techniques and systems to perform this increase of tension are described herein.

In various examples, the installation procedure for the mooring line system 300 may proceed as follows. The anchor 350 (and, in typical examples, multiple similar anchors) may be installed on the seafloor 380. Such anchors may be driven into the seafloor 380, drag-embedded, and/or otherwise installed using one or more other fixed anchor installation techniques. The mooring line segment 346 may then be attached to the anchor 350 (and, in examples, other mooring lines may be similarly attached to other anchors). The FRP-monopile 310 may also be installed on the seafloor 380 (e.g., driven into the seafloor 380). Because the installation of the anchors and the FRP-monopile are independent in this example, they may be installed in any order.

The TMA 320 may be mounted on the FRP-monopile 310 before or after the FRP-monopile 310 is installed on the seafloor 380. The mooring line segment 342 may also be installed at the TMA 320 at any point, and specifically connected to the stopper 324 through the porch 322. Once the FRP-monopile 310 configured with the TMA 320 and the mooring line segment 342 is installed, the mooring line segment 346 may be retrieved (e.g., from the seafloor 380) and connected to the mooring line segment 342 via the connector 344.

The tension on the mooring line 340 (e.g., mooring line segments 342 and 346 connected via connector 344) may then be adjusted using the TMA 320. In various examples, this tension may be increased or decreased after the initial mooring line 340 installation by manipulation of the stopper 324. The tension may then later be similarly adjusted as needed (e.g., using the TMA 320 and, specifically, by manipulating the stopper 324) to maintain tension on the mooring line 340 within a desired or designed tension range. For example, a load cell may be configured at a point along the mooring line 340 (e.g., as or as connector 344) and/or where the mooring line 340 attaches to the stopper 324. This load cell may provide periodic, on-demand, and/or continuous tension monitoring to an operator who may then implement maintenance adjustments to the tension on the mooring line 340 by manipulating the TMA 320 as described herein.

Figure 4:
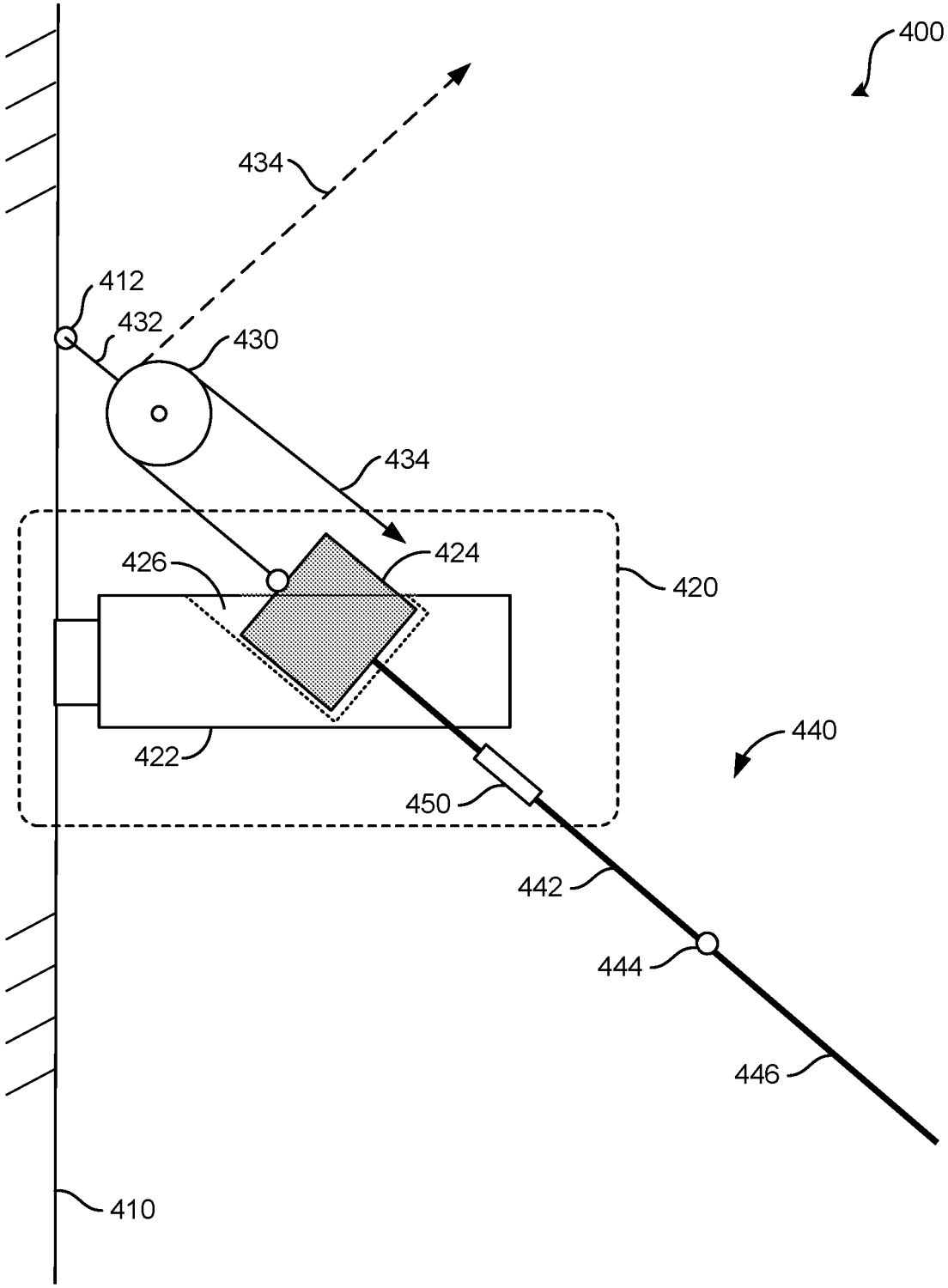
FIG. 4 illustrates a mooring line tensioning system, in accordance with examples of the disclosure.

FIG. 4 illustrates a mooring line system 400 according to various examples. More specifically, FIG. 4 illustrates a TMA 420 representing a particular example of a TMA that may be used to maintain tension on a mooring line. The TMA 420 may be installed at an FRP-monopile 410 that may be any type of FRP-monopile or other marine structure as described herein. As with other examples described herein, a single mooring line and associated components are illustrated and described for exemplary purposes, but multiple mooring lines and their associated components may typically be installed at an FRP-monopile.

A mooring line 440 may include an upper mooring line segment 442 and a lower mooring line segment 446 connected to one another by a connector 444. In various examples, a load cell 450 may be configured on the mooring line 440 to detect and report tension measurements. While shown as configured at the upper mooring line segment 442 in FIG. 4, the load cell 450 may be configured at any point along the mooring line 440 or at a terminal end of the mooring line 440. In some examples, a mooring line may be configured with more than one load cell or no load cells.

The mooring line 440 may be connected to a stopper 424 of the TMA 420. The TMA 420 may also include a porch 422 configured to support and restrain the stopper 424 (and, accordingly, the tension provided by the mooring line 440). The porch 422 may include a cavity, recess, or other section 426 on or into which the stopper 424 may be seated or otherwise engaged.

The stopper may be connected to and manipulated by a tensioning cable 434 configured at a pulley 430. The pulley 430 and related components may be installed and used for the initial installation and tensioning of the mooring line 440 and removed following the installation. Alternatively or additionally, the pulley 430 and related components may be installed from time to time as needed to adjust the tension in the mooring line 440. For example, the pulley 430 may be configured with a hook 432 that may be connected to an eye 412 configured at the FRP-monopile 410. Using this hook and eye configuration, the pulley 430 may be quickly and easily installed and removed as needed. In other examples, the pulley 430 may be permanently affixed to the FRP-monopile 410 and/or the TMA 420.

The tension on the mooring line may be increased by pulling the tensioning cable 434. For example, the tensioning cable 434 may be pulled from below by a boat or other means located at sea level and proximate to the FRP-monopile 410 (indicated by the solid line 434). Alternatively, the tensioning cable 434 may be pulled from above by a crane (e.g., configured on a vessel) or other means located above the pulley 430 and proximate to the FRP-monopile 410 (indicated by the dashed line 434). Once the appropriate tension is applied to the mooring line 440, the stopper may be secured in place (e.g., as described in more detailed examples herein). In some examples, the pulley 430 and related components may then be removed from the FRP-monopile 410.

In various examples, the installation and use of the pulley 430 for tensioning the mooring line 440 may proceed as follows. The hook 432 of the pulley 430 may be attached to the eye 412 of the FRP-monopile 410. The tensioning cable 434 may then be connected to the stopper 424. The tensioning cable 434 may be pulled (e.g., from above, below, or horizontally) using a boat, crane, or other means. This pulling will change the position of the stopper 424 relative to the porch 422. While the tensioning cable 434 is being pulled, the tension on the mooring line 440 may be monitored (e.g., using the load cell 450). When the desired tension is achieved by pulling on the tensioning cable 434, the stopper 424 may be secured in place at its current position (e.g., using one or more techniques described herein). In some examples, once the stopper 424 is secured in place, maintaining the desired tension on the mooring line 440, the tensioning cable 434 may be disconnected from the stopper 424 and the pulley 430 and related components may be removed from the FRP-monopile 410.

Figure 5:
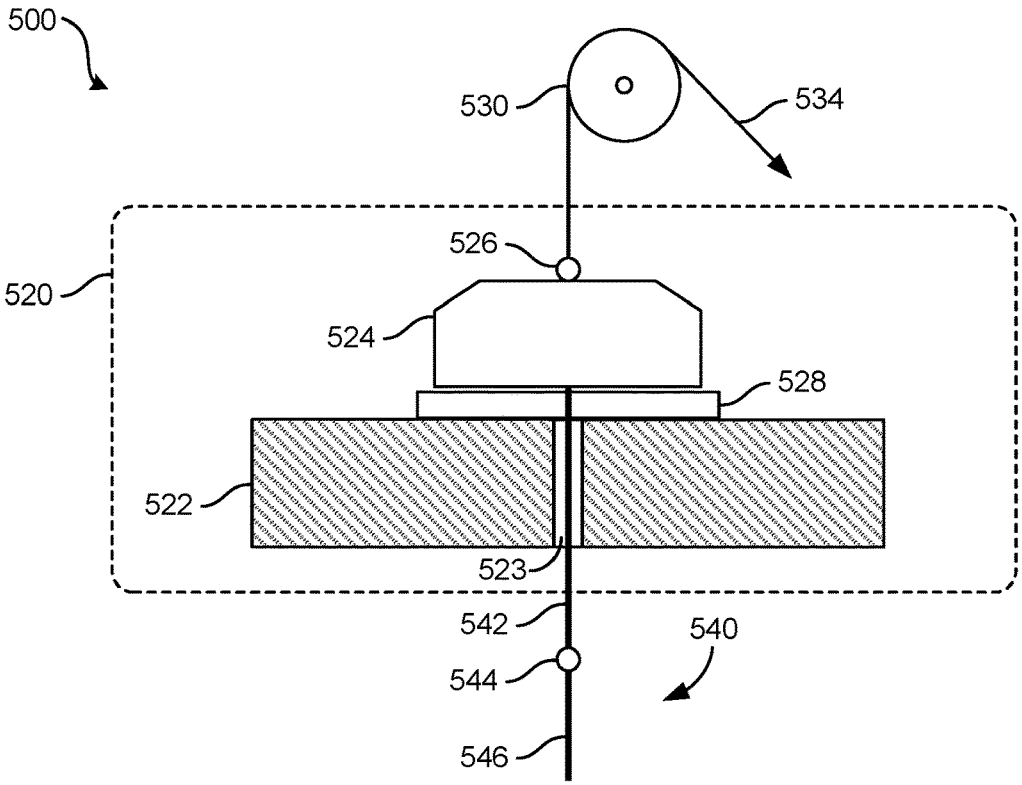
FIG. 5 illustrates a top mooring assembly (TMA) and tensioning system, in accordance with examples of the disclosure.

Various systems and techniques are disclosed herein for maintaining a position of a stopper relative to a porch in order to maintain tension on a mooring line. FIG. 5 illustrates a system 500 that may include an exemplary TMA 520 in which some such systems and techniques may be implemented. The TMA 520 may include a stopper 524 and a porch 522. The stopper 524 may be connected to a mooring line 540 that passes through an opening 523 in the porch 522. The mooring line 540 may include an upper mooring line segment 542 and a lower mooring line segment 546 connected by a connector 544. The upper mooring line segment 542 and/or the connector 544 may be adjustable in length and/or connected to the stopper 524 using a coupling component that may be adjustable in length. The upper mooring line segment 542 may connect to the stopper 524 using a hook configured to connect to an eye configured on the stopper 524.

The stopper 524 may include an eye 526 and/or other means of connecting to a stopper manipulation component. In this example, a tensioning cable 534 of a pulley 530 may be connected to the eye 526, but any other means of moving, repositioning, or otherwise manipulating the position of the stopper 524 may be used. The position of the stopper 524 may be adjusted relative to the porch 522 (e.g., by pulling on the tensioning cable 534 of the pulley 530) until the tension on the mooring line 540 is within a desired tension range.

When the stopper 524 is in a desired position, one or more gaskets 528 may be inserted between the stopper 524 and the porch 522 to maintain the position of the stopper 524 relative to the porch 522. For example, the gasket 528 may be approximately the same width as the distance between the stopper 524 and the porch 522 when the stopper 524 is in a desired position. By inserting a gasket 528 of this width, the stopper 524 may be released from the tensioning component (e.g., pulley 530) and remain in the desired position. Gaskets such as gasket 528 may be prefabricated in varying widths so that a variety of distances between stoppers and porches may be configured using such gaskets. In some examples, multiple gaskets may be used to maintain this distance. Gaskets may be incrementally added to a TMA as the distance between a stopper and a porch increases over time due to mooring line tension adjustments. Other stopper retention components may also, or instead, be used to maintain a stopper at a particular position relative to a porch, including as described herein. For example, washers of any suitable type and/or dimensions may also, or instead, be used to maintain a stopper at a particular position relative to a porch.

Figure 6:
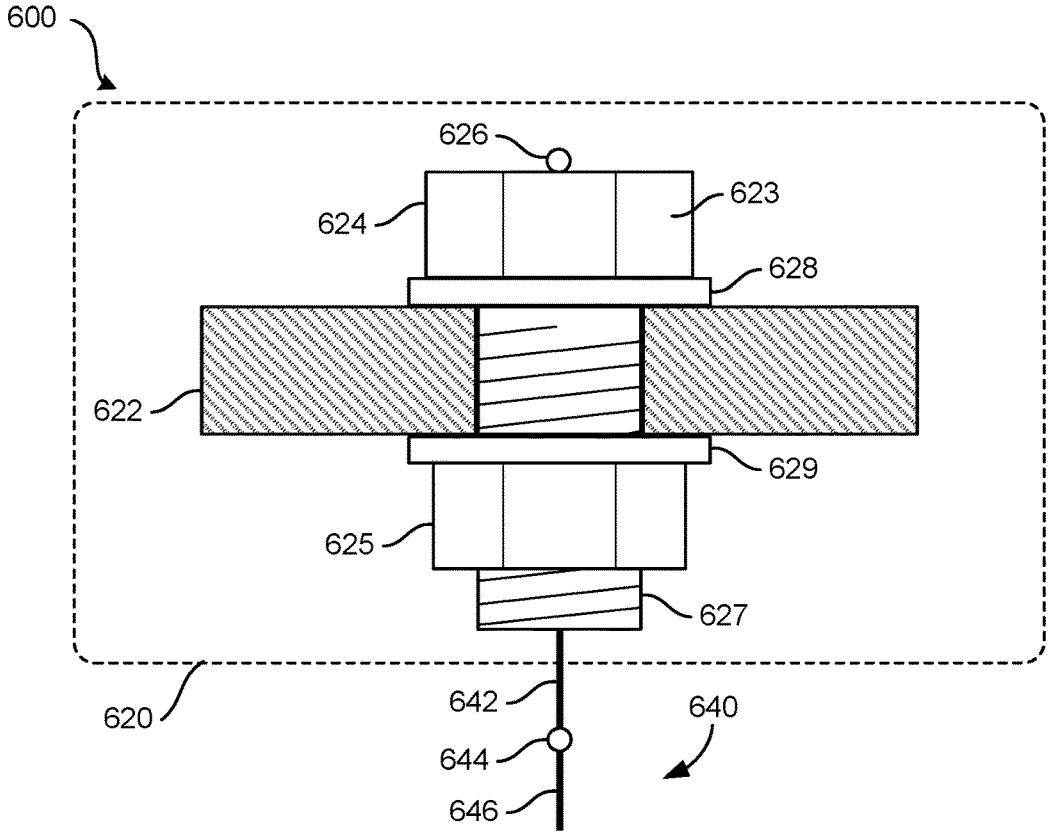
FIG. 6 illustrates a TMA, in accordance with examples of the disclosure.

FIG. 6 illustrates a system 600 that may include an exemplary TMA 620 in which some systems and techniques for maintaining stopper position may be implemented. The TMA 620 may include a stopper 624 and a porch 622. The stopper 624 may be connected to a mooring line 640 that may include an upper mooring line segment 642 and a lower mooring line segment 646 connected by a connector 644. The upper mooring line segment 642 and/or the connector 644 may be adjustable in length and/or connected to the stopper 624 using a coupling component that may be adjustable in length. The upper mooring line segment 642 may connect to the stopper 624 using a hook configured to connect to an eye configured on the stopper 624 (e.g., at the bottom of the threaded section 627).

In this example, the stopper 624 may resemble a bolt with a stopper head 623 above the porch 622 and configured to engage with the porch 622, and a threaded section 627 that may extend through the porch 622. The stopper 624 may also include an eye 626 that may be connected to a stopper position manipulation component, such as a pulley (not shown in FIG. 6). The mooring line 640 may be connected to the bottom of the threaded section 627 or may extend through the threaded section 627 to connect to the stopper head 623.

In this example, a gasket 628 may be used to maintain the distance between the head 623 of the stopper 624 and the porch 622. The stopper 624 may be repositioned using the techniques described herein until the tension on the mooring line 640 is within a desired tension range. Once the stopper 624 is in a desired position, one or more gaskets 628 may be installed between the head 623 and the porch 622 to maintain the position of the head 623 relative to the porch 622. For example, the gasket 628 may be approximately the same width as the distance between the head 623 and the porch 622 when the stopper 624 is in a desired position. By inserting a gasket 628 of this width, the stopper 624 may be released from the tensioning component (e.g., a pulley) and remain in the desired position. Here again, gaskets such as gasket 628 may be prefabricated in varying widths so that a variety of distances between stoppers or stopper heads and porches may be configured using such gaskets. In some examples, multiple gaskets may be used to maintain this distance. Gaskets may be incrementally added to a TMA as the distance between a stopper or stopper head and a porch increases over time due to mooring line tension adjustments. As noted, washers of any suitable type and/or dimensions may also, or instead, be used to maintain a stopper at a particular position relative to a porch.

A nut 625 may be screwed onto the threaded section 627 of the stopper 624 to secure the stopper 624 in the current position. The nut 625 may be screwed up to the bottom of the porch 622, securing the stopper 624 in position. Alternatively, a washer or other gasket 629 may be configured between the nut 625 and the bottom of the porch 622, for example, to ensure a durable positioning of the nut 625. The use of a nut in the TMA configuration may provide additional positioning security for a stopper beyond just the tension provided by a mooring line. In various examples, the bolt and nut configuration of the TMA 620 may facilitate ease of installation by allowing adjustment (or removal) of the nut 625 to allow the stopper 624 to be lowered toward the mooring line 640 to facilitate attachment of the mooring line 640 to the stopper 624. The nut 625 may then be mated to the stopper 624 and/or tightened onto the stopper 624 to increase the tension on the mooring line 640 after connection to the stopper 624.

Figure 7:
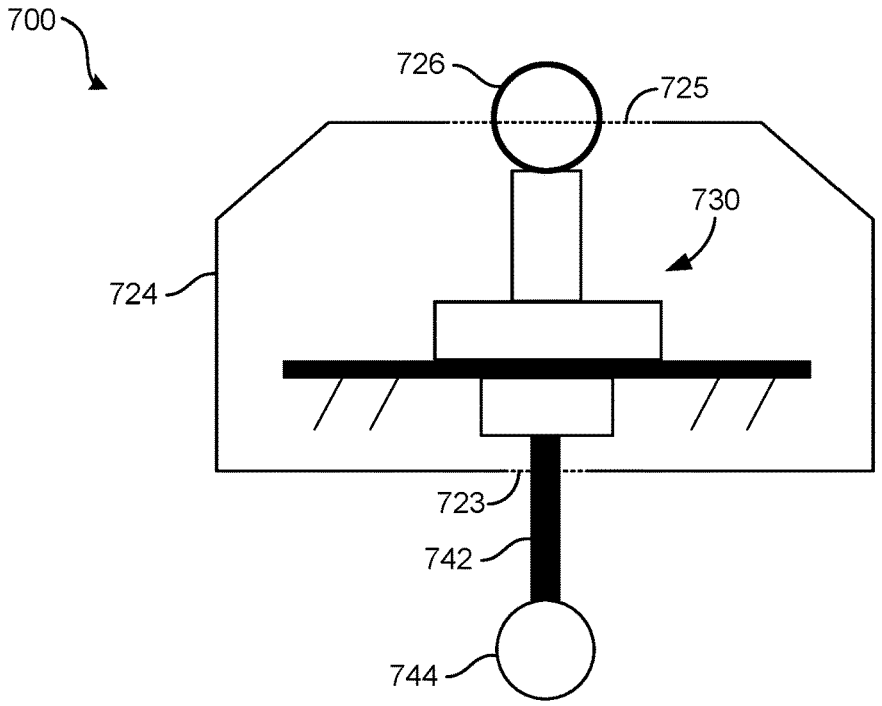
FIG. 7 illustrates a stopper and mooring line fitting, in accordance with examples of the disclosure.

FIG. 7 illustrates a system 700 for attaching a mooring line segment 742 to a stopper 724. The mooring line segment 742 may be an upper mooring line segment and may connect to a connector 744 that may be connected to a lower mooring line segment (not shown) as described herein.

In this example, a fitting 730 may be configured within the stopper 724 that may secure the mooring line segment 742 within the stopper 724. The mooring line segment 742 may pass through an opening 723 in the bottom of stopper 724 to connect to the connector 744. The fitting 730 may be further secured to an eye 726 that may pass through or be accessible via an opening 725 in the top of the stopper 724. The configuration of the fitting 730 within the stopper 724 to secure the mooring line segment 742 to the eye 726 allows for pulling of the eye 726 to result in pulling of the mooring line segment 742 along with the stopper 724.

Figure 8:
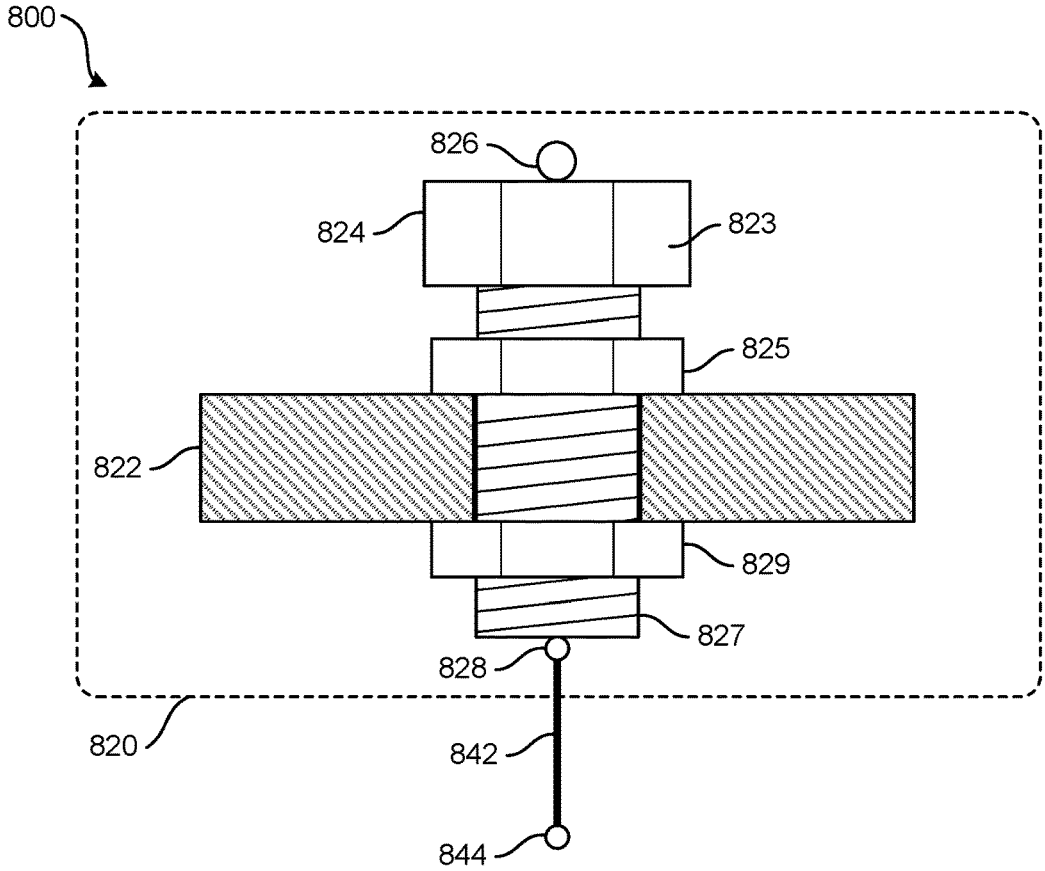
FIG. 8 illustrates a TMA, in accordance with examples of the disclosure.

FIG. 8 illustrates a tensioning system 800 that may implement a bolt and nut tensioning technique (e.g., as opposed to a pulley system) using a TMA 820. The TMA 820 may include a stopper 824 and a porch 822. In this example, the stopper 824 may resemble a bolt with a stopper head 823 above the porch 822 and/or configured to engage with the porch 822, and a threaded section 827 that may extend through the porch 822. The stopper 824 may also include an eye 826 that may be connected to a stopper position manipulation component, such as a pulley (not shown in FIG. 8). A mooring line segment 842 may be connected to the bottom of the threaded section 827 at an eye 828 (e.g., using a hook attached to the end of the mooring line segment 842) or may extend through the threaded section 827 to connect to the stopper head 823. The mooring line segment 842 may be an upper mooring line segment and may connect to a connector 844 that may be connected to a lower mooring line segment (not shown) as described herein.

In this example, an upper nut 825 and a lower nut 829 may be used to secure the topper 824 in a desired position and to maintain a distance between the head 823 of the stopper 824 and the porch 822. To reposition the stopper 824, the nuts 825 and 829 may be loosened (e.g., adjusted away from the porch 822) and the stopper 824 may be repositioned using the techniques described herein until the tension on the mooring line is within a desired tension range. In some examples, the lower nut 829 may be removed from the threaded section 827 for tensioning operations. Once the stopper 824 is in a desired position, the nuts 825 and/or 829 may be tightened (e.g., adjusted to compress the porch 822) to maintain the position of the head 823 relative to the porch 822. Alternatively, the position of the stopper 824 may be adjusted by turning the stopper 824 within the nuts 825 and 829 to move the head 823 of the stopper 824 up or down relative to the porch 822. The nuts 825 and 829 may be tightened to secure the stopper 824 in position. In this configuration, the upper nut 825 may serve to maintain the position of the stopper 824 relative to the porch 822 while the lower nut 829 may serve to further secure the stopper 824 in position. In this example, the tension of mooring line is countered by the upper nut 825, reducing the tension applied to threads of the threaded section 827.

In various examples, the bolt and nut configuration of the TMA 820 may facilitate ease of installation by allowing adjustment (or removal) of the nut 825 and/or the nut 829 to allow the stopper 824 to be lowered toward the mooring line segment 842 to facilitate attachment of the mooring line segment 842 to the stopper 824. The nuts 825 and/or 829 may then be mated to the stopper 824 and/or tightened onto the stopper 824 to increase the tension on the mooring line segment 842 after connection to the stopper 824.

Figure 9:
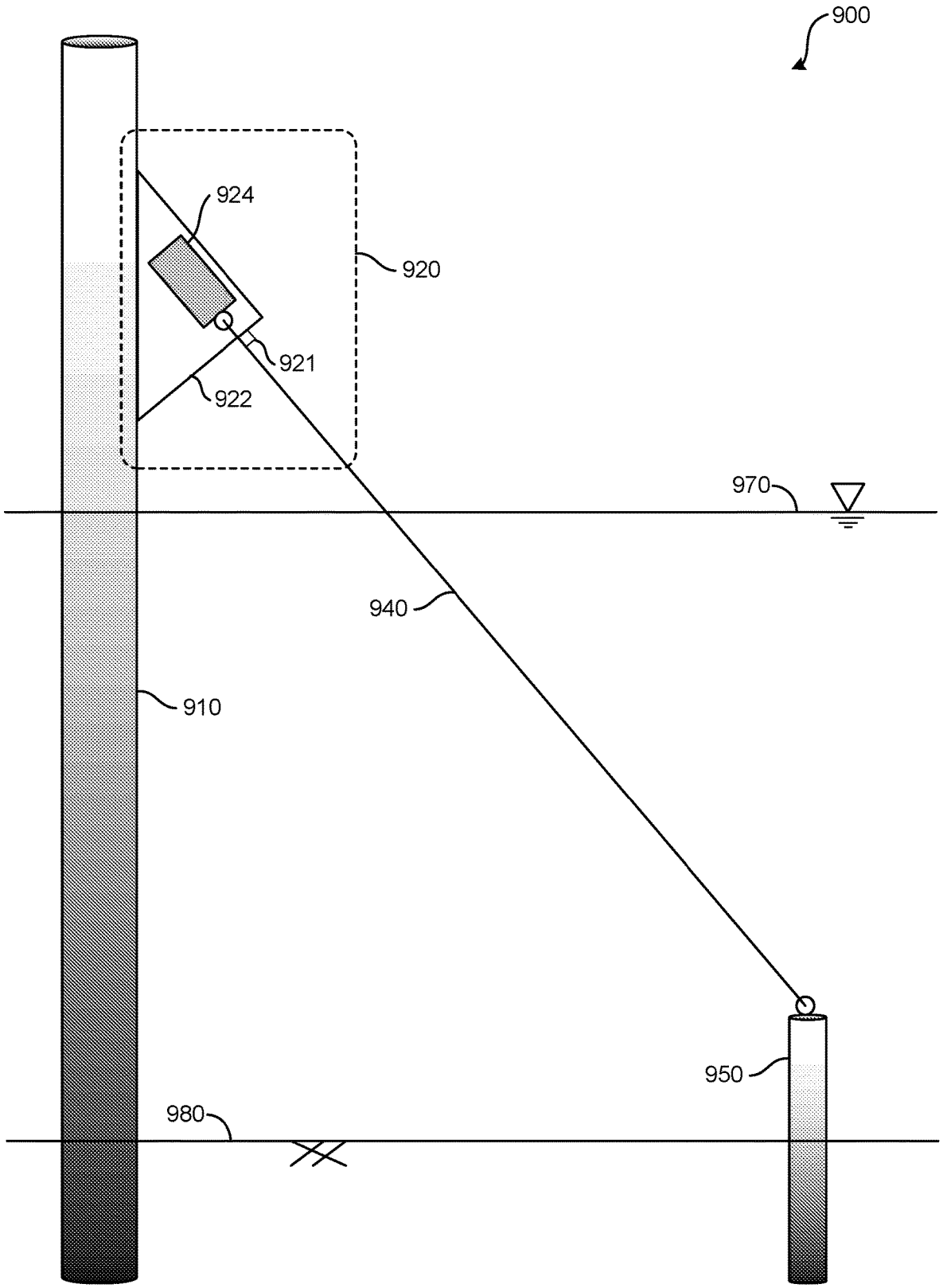
FIG. 9 illustrates an FRP, mooring lines, and a mooring line tensioning system, in accordance with examples of the disclosure.

FIG. 9 illustrates a mooring line system 900 for mitigating motion at an FRP-monopile according to various examples. An FRP-monopile 910 may be driven into or otherwise attached to a seafloor 980. At least a portion of the FRP-monopile 910 may be below the waterline 970, while another portion may be above the waterline. The FRP-monopile 910 illustrated in FIG. 9 may be a transition piece (e.g., transition piece 130 of FIG. 1), a monopile (e.g., monopile 140 of FIG. 1), one or more other portions of an FRP-monopile, or any combination thereof.

A mooring line 940 may be used to mitigate forces or motions applied to the FRP-monopile 910. Here again, a single mooring line is illustrated for exemplary purposes, but multiple mooring lines and their associated components may typically be installed at an FRP-monopile. The mooring line 940 may include one or more segments, connectors, and/or load cells as described herein. The mooring line 940 may be connected to an anchor 950 that may be driven into or otherwise attached to the seafloor 980.

A TMA 920 may be mounted on or otherwise attached to the FRP-monopile 910. The TMA 920 may include a mooring porch 922 affixed to the FRP-monopile 910 and a stopper 924 to which the mooring line 940 may be connected. In this example, the porch 922 may be configured such that its bottom surface may be perpendicular 921 to the departure angle of the mooring line 940 as shown in this figure. To maintain this orientation, the porch 922 may be rotatably affixed to the FRP-monopile 910 such that it may rotate about a horizontal axis (e.g., for a limited range of motion, such as up to 30 degrees, up to 60 degrees, etc.). In various examples, the installation procedure for the mooring line system 900 may be similar to that of the system 300 described above in reference to FIG. 3. The various tensioning systems and techniques described herein may also be applied to the system 300 of FIG. 3.

Figure 10:
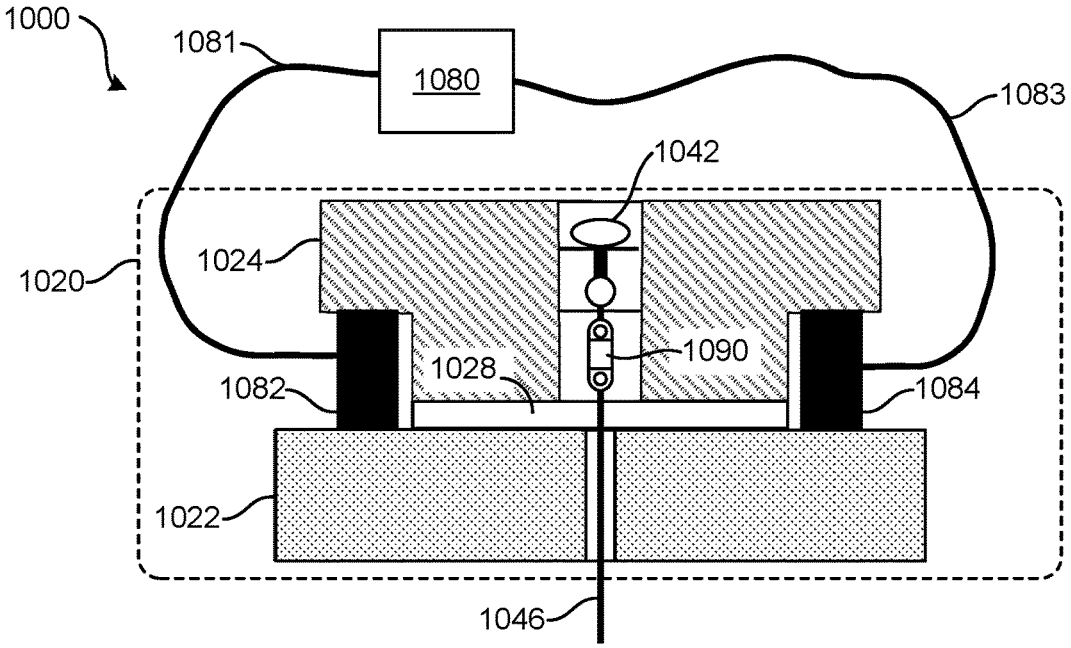
FIG. 10 illustrates an TMA, in accordance with examples of the disclosure.

FIG. 10 illustrates a tensioning system 1000 that may include an exemplary TMA 1020. The TMA 1020 may include a stopper 1024 and a porch 1022. The stopper 1024 may be connected to a mooring line segment 1046 that may be an upper mooring line segment of a mooring line as described herein. The mooring line segment 1046 may extend through an opening in the porch 1022 to connect to a fitting 1042 that may affix the mooring line segment 1046 to the stopper 1024. In some examples, a load cell 1090 may be configured between the fitting 1042 and the mooring line segment 1046. Alternatively, the fitting 1042 may directly connect the mooring line segment 1046 to the stopper 1024. In examples, the fitting 1042 may be adjustable (e.g., in length) to facilitate installation of the mooring line segment 1046. The mooring line segment 1046 and/or the fitting 1042 may be adjustable in length and/or a coupling component that may be adjustable in length may be used to connect the mooring line segment 1046 to the fitting 1042. The fitting 1042 may include an eye that may be configured to receive a hook configured at the end of the mooring line segment 1046 that may be used to connect the mooring line segment 1046 to the fitting 1042.

In this example, rather than a pulling force being used to manipulate the position of the stopper 1024, a "pushing" force may be used to increase the distance between the stopper 1024 and the porch 1022. In examples, one or more hydraulic cylinders may be used to increase the distance between the stopper 1024 and the porch 1022. For instance, hydraulic cylinder 1082 and hydraulic cylinder 1084 may be removably positioned between the stopper 1024 and the porch 1022. Hydraulic cylinders 1082 and 1084 may be controlled by a hydraulic power unit (HPU) 1080 that may increase and decrease the hydraulic pressure within each of the cylinders 1082 and 1084. The HPU 1080 may control the hydraulic cylinders 1082 and 1084 using connections 1081 and 1083, respectively. The connections 1081 and 1083 may be hoses or any other type of (e.g., flexible) conduit of hydraulic fluid of any type. In various examples, one or more hydraulic cylinders, such as hydraulic cylinders 1082 and 1084, may be integrated into and/or (e.g., permanently or semi-permanently) affixed or otherwise configured at a stopper, such as the stopper 1024.

The hydraulic cylinders 1082 and 1084 may initially have relatively low or no hydraulic pressure and therefore may have dimensions allowing them to be placed between the stopper 1024 and the porch 1022. The HPU 1080 may be operated to increase the hydraulic pressure in the hydraulic cylinders 1082 and 1084 until their respective dimensions increase (e.g., vertically with respect to a longitudinal axis of the mooring line segment 1046 or otherwise parallel inclined side of a porch, such as porch 922 shown in FIG. 9), raising the position of the stopper 1024 relative to the porch 1022 and increasing the distance between the stopper 1024 and the porch 1022. This in turn will increase the tension on the mooring line associated with the mooring line segment 1046. The pressure may be increased in the cylinders by the HPU 1080 until it is within a desired tension range.

When the stopper 1024 is in a desired position, one or more washers or gaskets 1028 may be inserted between the stopper 1024 and the porch 1022 to maintain the position of the stopper 1024 relative to the porch 1022. For example, the washer 1028 may be approximately the same width as the distance between the stopper 1024 and the porch 1022 when the stopper 1024 is in a desired position. After inserting a washer 1028 of this width, the HPU 1080 may be operated to decrease the hydraulic pressure in the hydraulic cylinders 1082 and 1084 until they can be removed from between the stopper 1024 and the porch 1022. The washer 1028 may maintain the stopper 1024 in the desired position. Note that one or more washers or gaskets may also be removed when the stopper 1024 is in a desired position. For example, a thinner washer may be removed and a thicker washer may be inserted between the stopper 1024 and the porch 1022.

As with other gaskets described herein, washers or gaskets such as washer 1028 may be prefabricated in varying widths so that a variety of distances between stoppers and porches may be configured using such washers. Washers according to the disclosed examples may include various markings and/or indentations that may facilitate placement and/or removal (e.g., with particular tools). As with other examples described herein, in the hydraulic cylinder tensioning examples multiple washers may be used to maintain a distance between a porch and a stopper. Washers or gaskets may be incrementally added to a TMA as the distance between a stopper and a porch increases over time due to mooring line tension adjustments.

Figure 11:
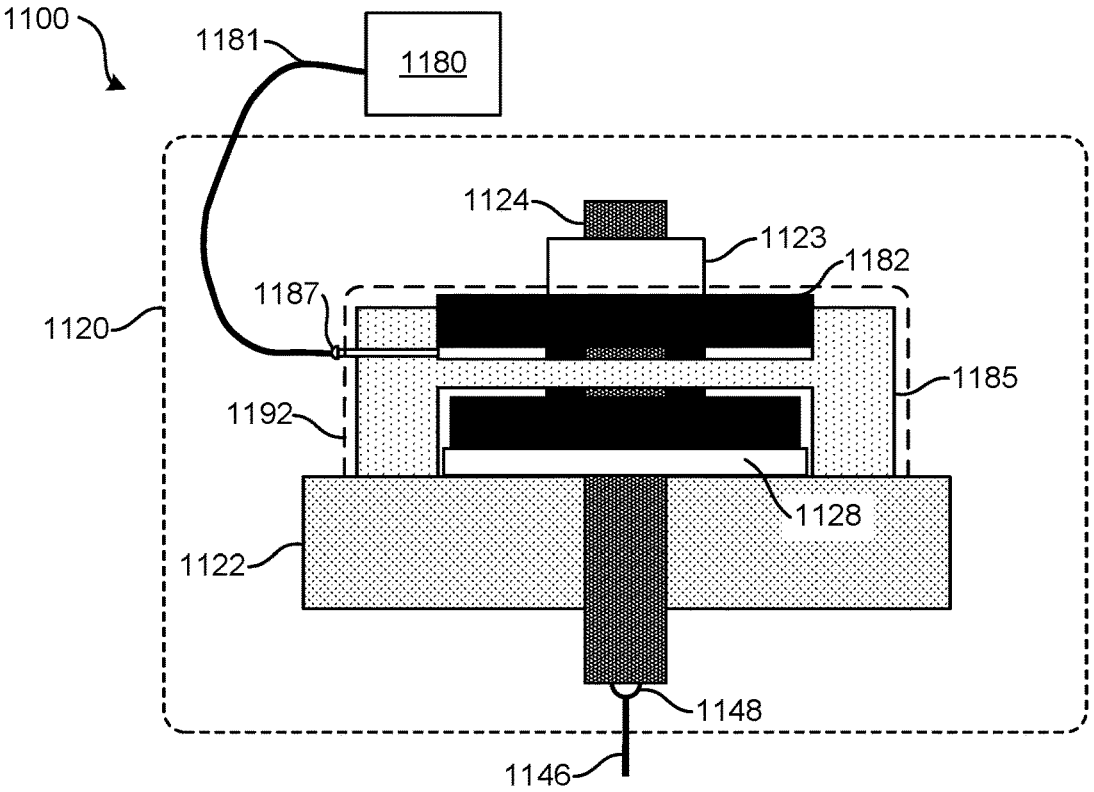
FIG. 11 illustrates an TMA, in accordance with examples of the disclosure

FIG. 11 illustrates a tensioning system 1100 that may include an exemplary TMA 1120. The TMA 1120 may include a bolt-type stopper having two or more components, including a stationary stopper component 1185 and a bolt-type stopper 1124. The TMA 1120 may also include a porch 1122. The stationary stopper component 1185 may be seated on a top side of the porch 1122 and may be fixed (e.g., may not move during tension adjustment operations). In various examples, the stationary stopper component 1185 may substantially surround the stopper 1124 and other components mated to the stopper 1124 and/or otherwise configured proximate to the stopper 1124. Alternatively or additionally, the stationary stopper component 1185 may substantially retain the stopper 1124 and other components mated to the stopper 1124 and/or otherwise configured proximate to the stopper 1124 in position (e.g., laterally). The stopper 1124 may extend through the stationary stopper component 1185 and the porch 1122 and may be configured with an eye 1148 or other coupling component at the bottom of the stopper 1124 that may be connected to a mooring line segment 1146. The stopper 1124 may be adjustable or otherwise capable of movement or repositioning (e.g., may move during tension adjustment operations). The stationary stopper component 1185 may include one or more opening or apertures that allow connectivity through the stationary stopper component 1185 to components within the stationary stopper component 1185. For example, a nozzle 1187 may extend through the stationary stopper component 1185 to allow (e.g., hydraulic) connectivity to hydraulic components within the stationary stopper component 1185 (e.g., connectivity of HPU 1180 using the connection 1181 via the nozzle 1187 to hydraulic components 1182).

Mooring line segment 1146 may be an upper mooring line segment of a mooring line as described herein. Alternatively, the mooring line segment 1146 may represent a single segment (e.g., one piece) mooring line). The eye 1148 may directly connect the mooring line segment 1146 to the stopper 1124, for example using a hook configured at the end of the mooring line segment 1146. In examples, the eye 1148 may represent a coupling component that may be adjustable (e.g., in length) to facilitate installation and tension adjustment on the mooring line segment 1146.

The TMA 1120 may use a pushing force to manipulate the position of the stopper 1224 and increase the distance between the stopper 1124 and the porch 1222. In examples, one or more hydraulic cylinders and/or other hydraulic components may be used to increase the distance between the stopper 1124 and the porch 1122. For instance, hydraulic components 1182 may represent any number hydraulic cylinders and/or other hydraulic components that may be (e.g., removably or non-removably) positioned between the stopper 1124 and the porch 1122. The hydraulic components 1182 may be controlled by an HPU 1180 that may increase and decrease the hydraulic pressure within the hydraulic components 1182 using a connection 1181 that may represent any number and type of hydraulic connections, such as one or more hoses or other type of (e.g., flexible) conduit of hydraulic fluid of any type. In various examples, the hydraulic components 1182 may be integrated into and/or (e.g., permanently or semi-permanently) affixed or otherwise configured at the TMA 1120.

Similar to the procedure used in the system of FIG. 10, the hydraulic components 1182 may be operated to increase hydraulic pressure in such components to raise the position of the stopper 1124 relative to the porch 1122, thereby increasing the distance between the stopper 1124 and the porch 1122 and, thus, the tension on the mooring line associated with the mooring line segment 1146. The stationary stopper component 1185 may remain fixed and stationary during this operation while allowing the stopper 1124 position to be adjusted. The pressure may be increased in the hydraulic components 1182 until the mooring line is within a desired tension range.

When the stopper 1124 is in a desired position, one or more washers or gaskets 1128 may be inserted between the stopper 1124 and the porch 1122 to maintain the position of the stopper 1124 relative to the porch 1122. For example, the washer 1128 may be approximately the same width as the distance between the stopper 1124 and the porch 1122 when the stopper 1124 is in a desired position. After inserting a washer 1128 of this width, the HPU 1180 may be operated to decrease the hydraulic pressure in the hydraulic components 1182 until they are needed to again adjust the tension on the mooring line or, in some examples, so that such components may be removed. The washer 1128 may maintain the stopper 1124 in the desired position. Here again, one or more washers or gaskets may also be removed when the stopper 1124 is in a desired position. For example, a thinner washer may be removed and a thicker washer may be inserted between the stopper 1124 and the porch 1122.

A nut 1123 may also be used to secure the stopper 1124 in position, in examples as described herein in regard to other nut and bolt type TMAs. In some examples, The bot-type stopper 1124 may not be threaded or may be threaded only in some portions. For example, the stopper 1124 may be threaded at the portion of the stopper 1124 where it mates with the nut 1123, but not in other portions.

In various examples, the bolt and nut configuration of the TMA 1120 may facilitate ease of mooring line installation by allowing adjustment (or removal) of the nut 1123 to allow the stopper 1124 to be lowered toward the mooring line segment 1146 to facilitate attachment of the mooring line segment 1146 to the stopper 1124. The nut 1123 may then be mated to the stopper 1124 and/or tightened onto the stopper 1124 to increase the tension on the mooring line segment 1146 after connection to the stopper 1124.

In various examples, a TMA may be configured with a protective cover or other enclosure that may help protect the TMA against environmental conditions and may therefore prolong the life of the components of the TMA. For example, the TMA 1120 may be configured with a cover 1192 that may substantially surround the components of the TMA 1120, such as the stopper 1124, the hydraulic components 1182, the washer 1128, and/or portions of the porch 1122. A protective covering or enclosure such as cover 1192 may include access components, such as a nozzle 1187 that may allow the connection 1181 from the HPU 1180 to access the hydraulic components 1182. The cover 1192 may be constructed of any suitable insulated material and/or combination of materials. Covers such as the cover 1192 may help insulate the TMA 1120 and/or components thereof from extreme temperatures and protect such components from moisture and other environmental elements that may otherwise accelerate the deterioration of such components.

As with other gaskets described herein, washers or gaskets such as washer 1128 may be prefabricated in varying widths so that a variety of distances between stoppers and porches may be configured using such washers. Washers according to the disclosed examples may include various markings and/or indentations that may facilitate placement and/or removal (e.g., with particular tools). As with other examples described herein, in the hydraulic cylinder tensioning examples multiple washers may be used to maintain a distance between a porch and a stopper. Washers or gaskets may be incrementally added to a TMA as the distance between a stopper and a porch increases over time due to mooring line tension adjustments.

Hydraulic tensioning systems and techniques as described herein may be used at initial installation of one or more mooring lines and/or for re-tensioning operations. Other means disclosed herein may also, or instead, be used to maintain a position of a stopper. For example, one or more hydraulic cylinders may be used to position a stopper in a nut and bolt type TMA where one or more nuts may be used to secure the position of a stopper (e.g., rather than, or in addition to, one or more washers or gaskets; see, e.g., FIGS. 6, 8, 11, and related text herein). Note that in other examples, one or more than two hydraulic cylinders may be used to "push" a stopper farther from a porch. All such cylinders may be controlled by a single HPU or multiple HPUs may be used to control subsets of such cylinders. In this example and other washer and gasket examples described herein, washers and/or gaskets may be inserted from the side of a TMA in between a stopper and a porch. Such washers and/or gaskets may be constructed of multiple separable segments to facilitate ease of installation.

Figure 12:
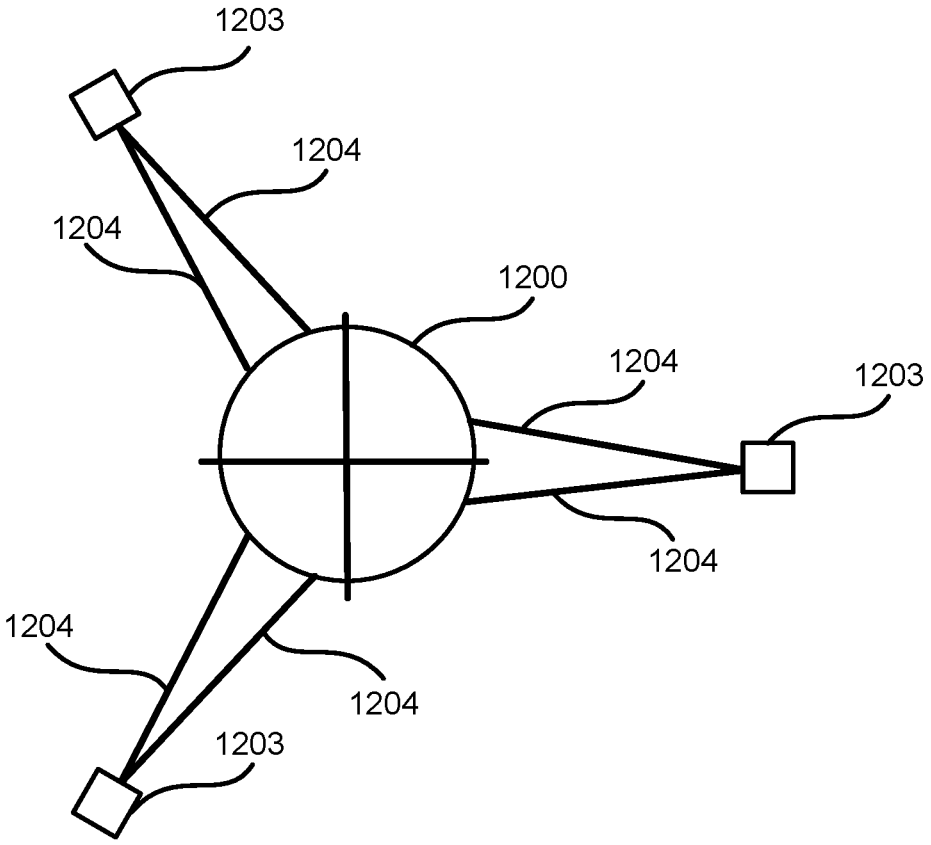
FIG. 12 illustrates fixed marine structure and mooring line configuration, in accordance with examples of the disclosure.

As noted, multiple mooring lines may be used to assist in resisting motions in the 6 DOFs applied by environmental forces to an FRP-monopile or other fixed marine structure. FIG. 12 illustrates an example structure 1200 that may be secured using multiple mooring lines 1204. In various examples, two or more mooring lines may be affixed to a single anchor. In this example, two mooring lines may be affixed to each of the individual anchors 1203. The mooring lines affixed to a particular anchor may form a group of mooring lines. There may be any number of mooring lines associated with a group of mooring lines. Any number of groups may be connected to a structure. In this example, there are three groups of mooring lines 1204 connected to structure 1200.

The mooring lines in each mooring line group may connect to a structure proximate to one another. For example, each of the mooring lines 1204 in an individual group of mooring lines may connect to an individual TMA configured at the structure 1200 that is proximate to another TMA used to connect to another mooring line in the same mooring line group.

Each mooring line of multiple mooring lines used to stabilize a structure may have a same or a substantially similar length, departure angle (from the structure), and/or initial tension. The initial tension or tension range for such lines may be determined such that there is little or no lateral load on the structure. The tension in mooring lines may be within a range such that the structure may remain subject to elastic resistance from the soil in which the anchors may be mounted (e.g., such that plastic deformation, if any, may be minimal). In examples, based on these conditions, individual mooring lines may be pre-tensioned fully to a design value (or value within a desired tension range) in one tensioning operation.

Figure 13:
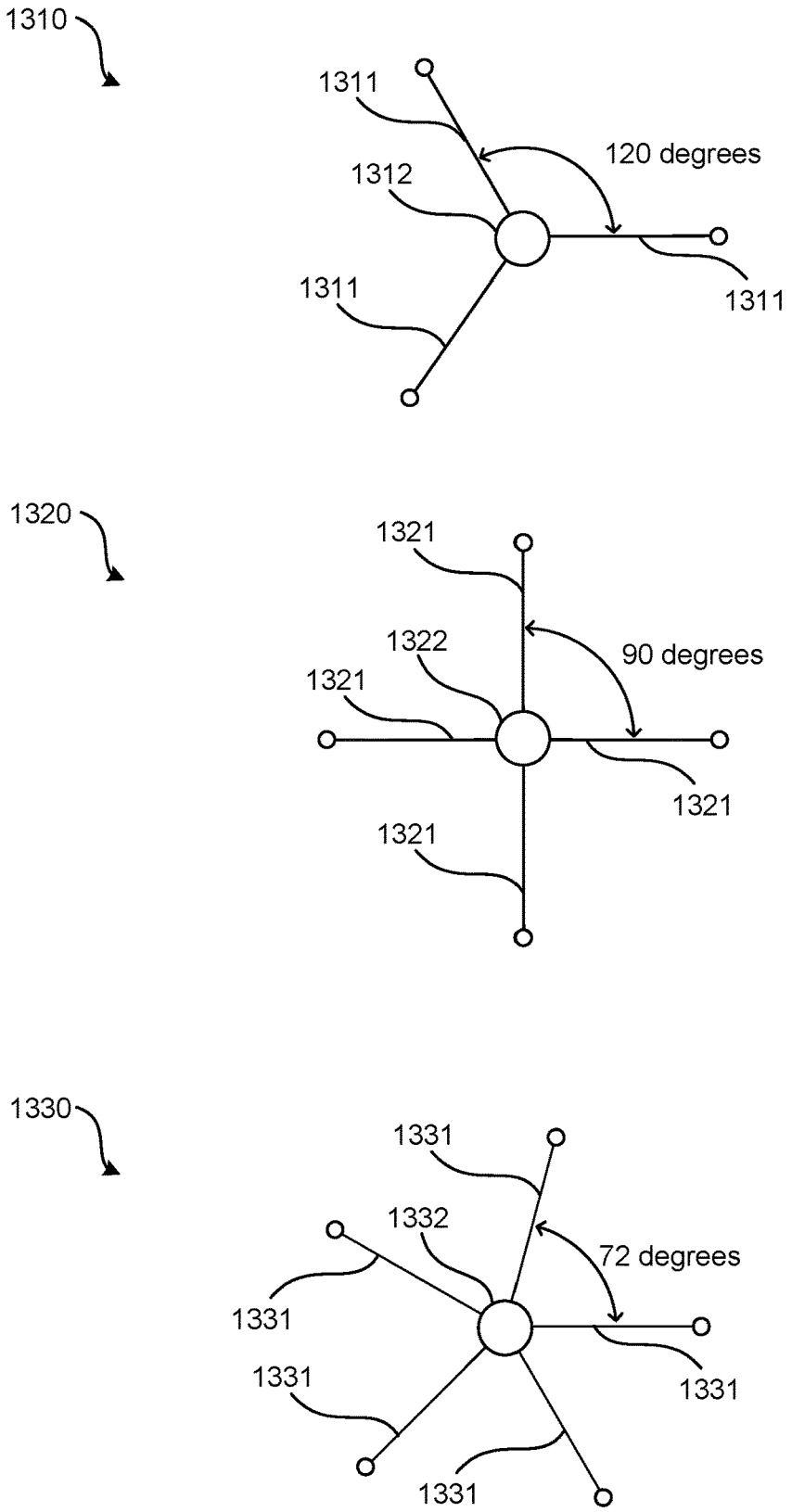
FIG. 13 illustrates several fixed marine structure and mooring line configurations, in accordance with examples of the disclosure.

Mooring lines, or groups of mooring lines, may be symmetrically distributed about the perimeter of a fixed marine structure. FIG. 13 illustrates several non-limiting examples of such configurations. In configuration 1310, a fixed marine structure 1312 may be secured by three groups 1311 of mooring lines. Each of the groups 1311 of mooring lines may have any number of mooring lines. Each mooring line in mooring line groups 1311 may be connected to a single anchor and may connect to the structure 1312 with a TMA that is proximate to other TMAs connecting other mooring lines in that substantially evenly about the perimeter of the structure 1312 (e.g., at separation angles of substantially 120 degrees).

In configuration 1320, a fixed marine structure 1322 may be secured by four groups 1321 of mooring lines. Here again, each of the groups 1321 of mooring lines may have any number of mooring lines, each mooring line in a group may be connected to a single anchor, and each mooring line in a group may connect to the structure 1322 with a TMA that is proximate to other TMAs connecting other mooring lines in the same group. As shown here, the four mooring line groups 1321 may be distributed substantially evenly about the perimeter of the structure 1322 (e.g., at separation angles of substantially 90 degrees).

In another example configuration 1330, a fixed marine structure 1332 may be secured by five groups 1331 of mooring lines. Here again, each of the groups 1331 of mooring lines may have any number of mooring lines, each mooring line in a group may be connected to a single anchor, and each mooring line in a group may connect to the structure 1332 with a TMA that is proximate to other TMAs connecting other mooring lines in the same group. As shown here, the five mooring line groups 1331 may be distributed substantially evenly about the perimeter of the structure 1332 (e.g., at separation angles of substantially 72 degrees).

Any other configuration and distribution of mooring lines and mooring line groups may be used are contemplated as within the scope of the instant disclosure. Moreover, any of the tensioning systems, TMAs, mooring lines, and associated components and techniques described may be used interchangeably. For example, any of the hydraulic and pulley tensioning techniques may be used with any stopper position securing techniques described herein, etc. All combinations of any of the various systems, components, techniques, and subsets thereof are contemplated as within the scope of the instant disclosure.

Based on the foregoing, it should be appreciated that technologies for minimizing movement of a fixed marine structure that may support a wind turbine have been presented herein. The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the true spirit and scope of the present invention, which is set forth in the following claims.

What is claimed is:

1. A system, comprising:

a fixed marine platform to host a wind turbine;

a mooring porch coupled to the fixed marine platform;

a stopper configured to engage with the mooring porch, the stopper comprises a threaded section extending through an opening configured in the mooring porch;

a nut configured about the threaded section of the stopper and on a bottom of the mooring porch;

an anchor attached to a seafloor;

a mooring line comprising a first end coupled to the anchor and a second end coupled to the stopper and extending through the mooring porch;

a hydraulic power unit;

one or more hydraulic cylinders connected to the hydraulic power unit and configured between the stopper and the mooring porch, wherein the one or more hydraulic cylinders are configured to expand under control of the hydraulic power unit to increase a distance between the stopper and the mooring porch; and one or more stopper retention components configured to secure the stopper in a position relative to the mooring porch.

2. The system of claim 1, wherein the fixed marine platform comprises a fully restrained platform monopile embedded into the seafloor.

3. The system of claim 2, wherein the seafloor is between a depth of about fifty meters and two hundred meters under a surface of water.

4. The system of claim 1, wherein the one or more stopper retention components comprise a washer configured between the stopper and the mooring porch via a side of the stopper and the mooring porch.

5. The system of claim 1, wherein the one or more stopper retention components comprise a nut configured about the threaded section and on a top of the mooring porch.

6. The system of claim 1, further comprising a load cell coupled along the mooring line and configured to measure a tension of the mooring line.

7. The system of claim 1 wherein the first end of the mooring line is coupled to the stopper by an adjustable length coupling component.

8. The system of claim 1, wherein the mooring line comprises a first segment comprising the first end, a second segment comprising the second end, and a connector connecting the first segment and the second segment.

9. The system of claim 1, wherein:

the mooring line further comprises a first end coupled to the anchor and a second end coupled to the stopper; and the mooring line extends through the mooring porch at a departure angle greater than zero degrees and less than ninety degrees with respect to a side surface of the fixed marine platform; and a bottom surface of the mooring porch is perpendicular to the departure angle.

10. A fixed marine structure, comprising:

a mooring assembly comprising:

a mooring porch; and a stopper having a threaded section extending through an opening configured in the mooring porch and configured to:

receive a mooring line attached to an anchor attached to a seafloor; and engage the mooring porch;

a nut configured about the threaded section of the stopper and on a bottom of the mooring porch; and a tensioning component configured to increase tension on the mooring line by increasing a distance between the stopper and the mooring porch.

11. The fixed marine structure of claim 10, wherein the fixed marine structure comprises a first end embedded into the seafloor and a second end configured to support a wind turbine.

12. The fixed marine structure of claim 10, further comprising:

a wind tower configured to support a wind turbine;

a monopile attached to the seafloor; and a transition piece connecting the wind tower and the monopile.

13. The fixed marine structure of claim 10, wherein the tensioning component comprises one or more hydraulic cylinders configured between the stopper and the mooring porch, the one or more hydraulic cylinders configured to increase the distance between the stopper and the mooring porch by pushing the stopper away from the mooring porch.

14. The fixed marine structure of claim 10, wherein the tensioning component comprises a pulley system, the pulley system configured to increase the distance between the stopper and the mooring porch by pulling the stopper away from the mooring porch.

15. The fixed marine structure of claim 10, wherein:

the mooring porch has a cavity along an upper surface; and the stopper is configured to engage within the cavity of the mooring porch.

16. A method to restrain motions of a platform that hosts a wind turbine, the method comprising:

attaching a mooring line anchored to a seafloor to a mooring assembly attached to the platform, the mooring assembly comprising a mooring porch and a stopper configured to receive the mooring line;

attaching a tensioning component to the stopper, the tensioning component configured to increase a distance between the stopper and the mooring porch;

moving the stopper from a first position to a second position by increasing the distance between the stopper and the mooring porch using the tensioning component;

securing the stopper at the second position; and removing the tensioning component from the stopper.

17. The method of claim 16, wherein securing the stopper at the second position comprises inserting one or more washers between the stopper and the mooring porch to retain the stopper at the second position.

18. The method of claim 16, wherein securing the stopper at the second position comprises configuring a nut about a threaded section of the stopper and against a top of the mooring porch.

19. The method of claim 16, further comprising attaching a plurality of mooring lines to the platform, wherein the plurality of mooring lines are substantially evenly distributed about a perimeter of the platform.

20. The method of claim 16, further comprising attaching a second mooring line anchored to the seafloor to a second mooring assembly attached to the platform, wherein the mooring line and the second mooring line are attached to a same anchor attached to the seafloor.

* * * * *